US006190064B1

(12) United States Patent
Lorenz et al.

(10) Patent No.: US 6,190,064 B1
(45) Date of Patent: Feb. 20, 2001

(54) DEVICE FOR INTERMEDIATE STORAGE OF PHOTOGRAPHIC SHEET MATERIAL

(75) Inventors: Bernhard Lorenz, Marzling; Rainer Regber, Kochel/Ried; Wilfried Hehn; Manfred Schlechte, both of Munich, all of (DE)

(73) Assignee: AGFA-Gevaert AG, Leverkusen (DE)

( * ) Notice: Under 35 U.S.C. 154(b), the term of this patent shall be extended for 0 days.

(21) Appl. No.: 09/391,822

(22) Filed: Sep. 8, 1999

(30) Foreign Application Priority Data

Sep. 16, 1998 (DE) ..... 198 42 443

(51) Int. Cl.[7] ..... G03D 3/08

(52) U.S. Cl. ..... 396/612; 271/189; 271/264; 226/189; 396/615

(58) Field of Search ..... 396/612, 615; 355/27–29; 271/264, 273, 225, 184–186; 226/189

(56) References Cited

U.S. PATENT DOCUMENTS 5,374,972 * 12/1994 Nakane et al. ..... 396/620

5,785,312 * 7/1998 Krupica et al. ..... 271/264

* cited by examiner

*Primary Examiner*—D. Rutledge
(74) *Attorney, Agent, or Firm*—Darby & Darby

(57) ABSTRACT

A device (1) for the intermediate storage of photographic material (4–8) in sheet form includes an entrance (2) for receiving the material (4–8), an exit (3) for discharging the material (4–8) and several rotatably supported rollers (9–16; 40, 41) which are provided to transport of the material in sheet form (4–8) from the entrance (2) to the exit (3) and can be driven by at least one drive means (17–22). A monitoring means (23, 24A, 24B) for monitoring positions of intermediately stored sheets (4–8) of the photographic material (4–8) is also provided. A control means (23) controls the rotation speeds of the driveable rollers (9–16; 40, 41) in such a way that during operation the rotation speed of at least one of the rollers (9–16; 40, 41) can be adjusted independently of the rotation speeds of the other rollers (9–16; 40, 41) in response to the monitored positions.

17 Claims, 2 Drawing Sheets

DEVICE FOR INTERMEDIATE STORAGE OF PHOTOGRAPHIC SHEET MATERIAL

BACKGROUND OF THE INVENTION

1. Field of the Invention

The present invention relates to it device for the intermediate storage of photographic sheet material with an entrance for receiving the material, an exit for discharging the material, several rotatably supported rollers for transporting the material in sheet form from the entrance to the exit and a drive means for driving the rollers.

2. Description of the Related Art

The devices this type can preferably be used in a so-called minilab. In the minilab, image originals recorded on photographic film are read with the device and the obtained image information is exposed on photographic sheet material in either analog or digital form. After the exposure step, the photographic sheet material is transferred to another station for developing the exposed photographic paper. The exposed image information which is recorded as a latent image of the photographic sheet, is thereby made visible and stabilized. Fully processed paper copies with the image information are returned at the exit of the minilab. The minilab performs the exposure end developing processes automatically in sequence. Disadvantageously, however, the exposure process may occur much faster than the developing process in which the photographic sheet paper passes through chemical baths which takes time. Since the image information of a following film is read only after the photographic paper associated with the current film has been fully exposed and developed, there may be a waiting time until the next film can be processed. This reduces the efficiency of the minilab.

It was therefore proposed in the U.S. Pat. No. 4,866, 47220 to arrange between the station exposing the photographic paper and the station developing the photographic paper a device for intermediate storage of the exposed photographic paper. According to U.S. Pat. No. 4,866,472, a container is placed between the exposure station and the developing station, in which container the exposed photographic sheet paper is inserted at an entrance disposed at the top of the container. An exit is provided at the underside of the container, wherein the exposed photographic paper intermediately stored in the container is transferred to the developing station over a roller. The different sheets of the photographic paper are arranged in the container in the form of stacks. With his arrangement, the sheets can be supplied and withdrawn consecutively. The sheets are processed in the exposure and developing station in the original order. Since the exposed photographic paper is stacked in the container one on top of the other and adjacent sheets make contact which each other, this conventional device may disadvantageously cause adjacent sheets to damage each other. For example, the sheets can stick to one another.

The European patent application EP 0 708 365 A1 discloses a device for the intermediate storage of photographic sheet material which obviates the aforedescribed disadvantages. In the device disclosed in this reference, the photographic sheet paper is inserted into the intermediate storage device after exposure in the exposure station and transported onward through the intermediate storage device towards the entrance of the developing station. This prevents individual sheets of photographic paper from coming into contact with each other in the intermediate storage device. Different arrangements are proposed for receiving and transporting the individual sheets in the intermediate storage device. All these arrangements have in common that the sheets are transported by a band which moves over drive rollers. The transport speed of the sheets transported through the intermediate storage device is thereby held constant. To ensure that the disclosed intermediate storage device has sufficient storage capacity for the intermediate storage of photographic sheet paper and that the transit time of a sheet to be intermediately stored is kept as short as possible, it is proposed to make the transport path of the sheets through the intermediate storage device dependent on the total number of sheets held in the intermediate storage device. Mechanical assemblies which can be used to vary the transport path of the intermediate storage device—and thereby also the storage capacity of the intermediate storage device—tend to be quite complex.

SUMMARY OF THE INVENTION

It is an object of the present invention to provide a device for the intermediate storage of photographic sheet material which has sufficient storage capacity, while at the same time ensuring that a sheet of the photographic material has a short residence time in the device.

This object is solved by that the device including a monitoring means for monitoring positions of intermediately stored sheets of the photographic material and a control means for controlling the rotation speeds of the driveable rollers, so that during operation the rotation speed of at least one of the rollers can be adjusted independently of the rotation speeds of the other rollers and dependent on the monitored positions.

According to one aspect of the invention, the rotation speed of at least one of the rollers provided in the device of the invention to transport the photographic sheet material can be adjusted depending on the positions of intermediately stored material. In this way, a high transport speed of the sheet material through the device of the invention and a correspondingly short residence time inside the device can be attained, thereby making the inventive device very efficient. Advantageously, the mechanical design is less complex which makes the device also very reliable. According to an advantageous embodiment of the invention, the separation between two driveable rollers is smaller than or equal to the length of the sheets of the photographic material to be intermediately stored. This arrangement provides a trouble-free transport of a sheet through the intermediate storage. Since the photographic material has a certain stiffness, the sheet can be easily transferred from one roller to the next.

According to another advantageous embodiment of the invention, additional rotatable rollers are arranged parallel to the driveable rollers for guiding the sheet material between such roller pair. This arrangement improves the transport of the photographic material. The additional rotatable rollers need not be themselves driveable.

Advantageously, the rotation speed of the rollers is adjusted so that a predetermined minimal separation is maintained between two consecutive sheets which are intermediately stored before the exit. This arrangement provides a certain freedom of movement and also a certain tolerance when the transport speeds is increased or decreased of during the transport of individual sheets through the device of the invention. In addition, two consecutive sheets are prevented from making contact with each other.

The positions of intermediately stored material can be easily monitored by driving the rollers with at least one stepping motor, wherein the individual steps for driving the rollers are measured and monitored. Since the steps executed by the at least one stepping motor correspond to a distance traveled by one of the intermediately stored sheets, the position of this sheet can be easily monitored in the device of the invention.

Any slippage between the rollers and the sheet when the sheet is transported between the rollers, can advantageously be recognized by a sensor. The current position of the sheet can thereby be determined more accurately, since the detected slippage during the determination of the position can be taken into account in addition to the monitored steps of the stepping motor. If the device according to the invention is advantageously arranged between an exposure station and a developing station, then—according to another advantageous embodiment—a signal can be produced and transmitted to the exposure station when the storage capacity of the storage device according to the invention has been reached. The exposure station can then advantageously adapt its processing speed for exposing the photographic material to the processing speed of the developing station.

According to yet another advantageous embodiment of the invention, and least two webs of sheets of photographic material that are placed next to each other, can be transported. The individual sheets have to be distributed by a distribution means to one of the at least two webs. This arrangement increases the storage capacity in a simple and space saving manner. Advantageously, several of the rollers can be subdivided into at least two individually driveable sub-rollers. This provides optimal flexibility for the intermediate storage of the sheets, as well as a large storage capacity and a small footprint of the storage device.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
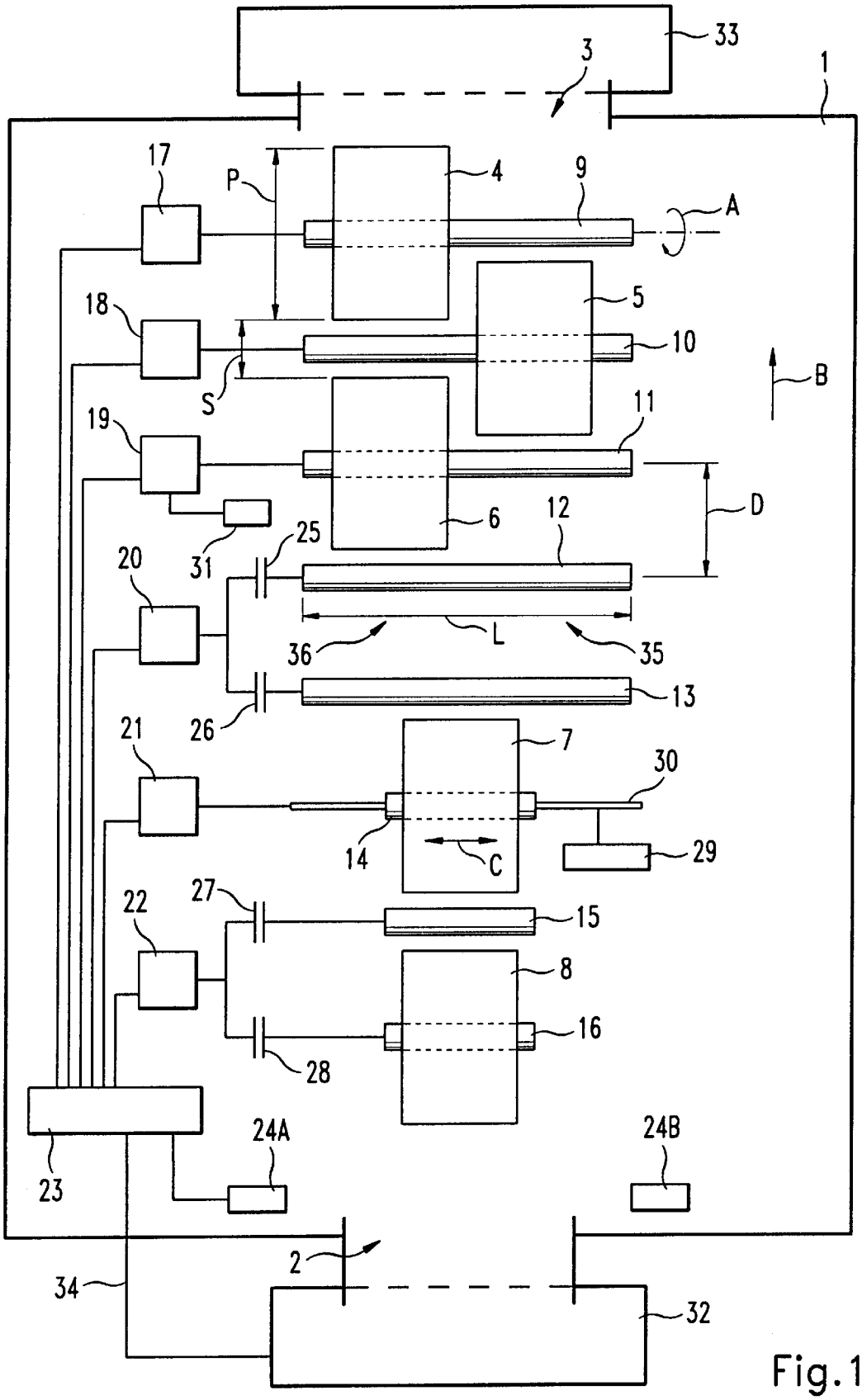
FIG. 1 is a schematic representation of a first embodiment of the device according to the invention.

In the following, identical components and components performing an identical function are designated with the same reference numerals.

FIG. 1 illustrates the first embodiment of the device according to the invention for the intermediate storage of photographic sheet material. The photographic material which is to be intermediately stored is photographic paper. The photographic paper may have different formats. The inventive device, however, is not restricted to the intermediate storage of photographic paper. Other photographic materials may also be intermediately stored. Such materials may be, for example, photographic film, in particular X-ray film in sheet form.

In the following, the inventive device for the intermediate storage of photographic paper will be called a "stocker" 1 and is illustrated in FIG. 1. The stocker 1 has an entrance 2 which is connected to a station 32 for exposing the photographic sheet paper. The stocker 1 has also an exit 3 which is connected to a station 33 for developing the exposed photographic paper. The exposure station 32, the stocker 1 and that developing station 33 are components of a so-called minilab. Customer supplied image information, in particular originals recorded on a photographic film, can be exposed in the minilab on photographic paper. The minilab may also include a scanner for reading image information recorded on the photographic originals.

Placing the stocker 1 between the exposure station 32 and the developing station 33 improves the efficiency of the minilab. For example, since exposed sheets of photographic paper are intermediately stored in the stocker 1, the scanner located in the exposure station 32 can be used to begin reading the image information of the subsequent film, even if the development of the photographic paper of the current film has not yet been completed. In other words, the exposure station 32 of the minilab and in particular its scanner can be used to process the subsequent film before all the paper copies of the current film have been produced. By inserting the stocker 1 between the exposure station 32 and the developing station 33, the exposure station 32 can operate essentially independently of the processing speed of the developing station 33.

The stocker 1 according to the invention includes a plurality of rotatably supported rollers, which are arranged one after the other in a cascading fashion, to provide intermediate storage and transport of the exposed photographic paper sheets supplied to the stocker 1 from the exposure station 32 through the entrance 2. The rollers 9 to 16 can be driven via drive means so that the rotation speed of the rollers can be adjusted independently of each other. For transporting the intermediately stored sheets, the drive means can rotate the rollers 9 to 16 in a rotation direction A. According to a particularly advantageous feature of the device of the invention, the drive means can be arranged so that the rotation speed of each driveable roller can be adjusted independently of the rotation speed of the other driveable rollers.

In the present embodiment, the drive means for driving the rollers are stepping motors. As shown in FIG. 1, the first roller 9 is connected to a first stepping motor 17. The second drive roller 10 is connected to a second stepping motor 18, and the third roller 11 is connected to a third stepping motor 19. The fourth roller 12 and the fifth roller 13 are driven by a fourth stepping motor 20. The stepping motor 20 is connected to the fourth roller 12 through a first coupling 25 and to the fifth roller 13 through a second coupling 26. The two couplings 25 and 26 which can be used to connect the stepping motor either to one of the two rollers 12 or 13 individually or to the two rollers together, serve as connecting means. A fifth stepping motor 21 is connected to and drives the sixth roller 14. A sixth stepping motor 22 is provided to drive the seventh roller 15 and the eighth roller 16. The stepping motor 22 can be connected through a third coupling 27 to the seventh roller 15 and through a fourth coupling 28 to the eighth roller 16. In the present embodiment, each off the stepping motors 17, 18, 19 and 21 is connected to a single roller. Each of the two stepping motors 20 and 22 drives two rollers. Alternatively, each of the rollers 9 to 16 can be provided with its own drive means, thereby eliminating connecting means, in particular mechanical couplings arranged between one of the stepping motors and several rollers to be driven by the stepping motor, which are subject to wear. Moreover, additional rollers or all the rollers incorporated in the paper stocker may be driven by one or several common stepping motors. The invention is not limited by technical details of the drive means for the rollers. A number of different conventional arrangements may be employed.

The stepping motors 17 to 22 used in the aforedescribed embodiment are controlled by a control means 23 connected to the stepping motors 17 to 22. The control means 23 transmits to the individual stepping motors 17 to 22 control signals setting the rotation speed of the individual rollers 9 to 16. The control means also controls the operation of the four couplings 25 to 28.

The stocker 1 further includes an input sensor 24A, 24B which is arranged directly at the entrance 2 of the paper stocker 1 and monitors insertion of a new sheet of photographic paper into the paper stocker. The input sensor in the present embodiment is implemented as a light gate. A light emitter 24A is located on the left side of the entrance 2, while a light receiver 24B facing the light transmitter 24A is located on the right side of the entrance 2. The light gate 24A, 24B is connected to the control means 23 to indicate to the control means 23 when a new photographic paper sheets is inserted into the stocker 1.

The input sensor 24A, 24B is part of a monitoring system of the stocker 1 for monitoring the positions of the sheets that are intermediately stored in the stocker. In addition, the control means 23 can monitor the steps executed by the individual stepping motors 17 to 23 driving the rollers 9 to 16 which transport the sheets inserted into the stocker 1. When the light gate 24A, 24B detects that a new sheet is inserted into the stocker 1, the position of this sheet in the stocker 1 can be determined by the control means 23. The position of the newly inserted sheet in the stocker 1 depends on its initial position and on the number of the steps executed by the respective rollers 9 to 16 which transport this sheet onward. Alternatively, the positions of the intermediately stored sheets can also be monitored in other ways, for example by providing a respective monitoring sensor on several or on each of the driveable rollers.

To improve the accuracy with which the actual position of a intermediately stored sheet can be determined, the stocker of the invention includes a slippage sensor 31. According to FIG. 1, the slippage sensor 31 is connected to the third stepping motor 19 and also to the control means 23. The slippage sensor 31 is capable of detecting a slippage between the rollers and the photographic paper sheet to be transported. The stocker according to invention may include several such slippage sensors. In the present embodiment according to FIG. 1, only one exemplary slipping sensor 31 is shown. The slippage sensors 31 can be implemented, for example, also as a light gate. The arrangement of the light gate 24A, 24B at the entrance 2 and of the slippage sensor 31 which in the present example is also a light gate, defines a predetermined distance between these two light gates. In this way, a sheet transported through the stocker 1 can be detected at both positions. Moreover, the control means 23 can determine from the monitored and measured stepping motor pulses applied to transport the photographic paper sheets the time that has elapsed between the detection of the transported photographic paper sheet by the light gate 24A, 24B and the detection by the slippage sensor 31. If the elapsed time is greater than the time which is typically needed to cover the distance from the light gate 24A, 24B to the slippage sensor 31 based on the measure stepping motor pulses, then slippage has occurred. The measured slippage can be used to correct the originally determined position of the photographic paper sheet based on the number of steps executed by the stepping motors.

The storage capacity of the stocker 1 in the present embodiment can be increased by providing two paper webs 35 and 36 so that two webs of photographic paper sheets arranged side-by-side can be intermediately stored in the stocker 1. The stocker for the intermediate storage of photographic paper sheets may also have more than two webs arranged side-by-side. In the aforedescribed first embodiment of FIG. 1, the photographic paper sheets are intermediately stored as two webs over a distance which is determined by the width of the rollers 9 to 13. Each of the rollers 9 to 13 has a width L designed to transport two sheets of the photographic paper next to each other so that the sheets do not make contact with each other during transport.

Since new sheets are inserted into the stocker 1 as a single web, the sheets which are first transported as a single web over the rollers 14–16, have to be distributed over the two webs 35 and 36. For this purpose, the stocker 1 of the invention is provided with a distribution means 29, 30 which is arranged on the sixth roller 14. Roller 14 is not only supported for rotation, but can also be displaced axially in a distribution direction C along an axis 30 arranged parallel to the rollers 9 to 16. The axis 30 operates as a guide rail for displacing the roller 14 in the distribution direction C. The distribution direction C extends perpendicular to a transport direction B for transporting the individual photographic paper sheets from the entrance 2 to the exit 3 of the stocker 1. The axis 30 is connected to a motor 29 for displacing the roller 14 in the distribution direction C. The motor 29 receives a control signal from the control means 23 so that a photographic paper sheet to be distributed can be distributed to one of the webs 35 or 36.

The stocker 1 holding five intermediately stored photographic paper sheets 4 to 8 is illustrated in FIG. 1. A first sheet 4 is located on the first roller 9, the second sheet 5 is located on the second roller 10, the third sheet 6 is located on the third roller 11, the forth sheet 7 is located on the sixth roller 14, and the fifth sheet 8 is located on the eighth roller 16. The first sheet 4 and the third sheet 6 are located on the second web 36 of the paper stocker. The second sheet 5 is located on the first web 35. The second sheet 5 intermediately stored on the first web 35 is offset in the transport direction B relative to the first sheet 4 and the third sheet 6. The third sheet 6 is intermediately stored on the second web 36 directly behind the first sheet 4. A minimal distance S is maintained between the first sheet 4 and the third sheet 6, wherein the distance S is advantageously adjusted in such that two photographic paper sheets which are transported directly one after the other, are prevented from making contact with each other during the transport. The separation between the two front edges of two photographic paper sheets arranged on the webs 35 and 36 in an offset position is (P+S)/2, wherein P corresponds to the length of the photographic paper sheets and S corresponds to the minimal distance to be maintained between two successive sheets on the same web. With this arrangement, the photographic paper sheets intermediately stored on two webs are packed as closely as possible and the individual sheets can be reliably transferred at the exit 3 to the developing station 33, while at the same time preventing the individual sheets from making contact with each other.

Each of the photographic paper sheets 4 to 8 illustrated in FIG. 1 has a sheet length P. To ensure that the sheets are transported reliably through the stocker 1, the separation D between two driveable rollers is smaller than or equal to the sheet length P. Due to the stiffness of the photographic paper sheets, the sheet to be transported can already be gripped by the next roller before being released from the roller presently transporting the sheet.

Since the rotation speed of the rollers 9 to 16 can be individually adjusted through the control means 23, a new photographic paper sheet inserted into the stocker 1 through the entrance 2 can be efficiently and quickly transported into direction of the exit 3 depending on the other photographic paper sheets which are already in intermediate storage. For example, if the stocker is completely empty before a new film is processed, then a first photographic paper sheets exposed by the exposure station 32 can be transported at high speed from the entrance 2 to the exit 3 of the stocker 1. All rollers 9 to 16 in the stocker 1 are then rotating with a very high rotation speed. When the number of photographic paper sheets intermediately stored in the stocker 1 increases, then the newly inserted sheets can be initially transported at high speed until they catch up with the sheets intermediately stored in front of the exit 3 which are transported onward at the processing speed of the developing station 33. In the present first embodiment, for example, the first three sheets 4 to 6 are transported at the slower processing speed of the developing station 33, whereas the sheets 7 and 8 can be transported at a high speed until they are intermediately stored directly behind the sheets 5 and 6 with the minimal separation S to be maintained. The fourth sheet 7 would then be transported and distributed by the distribution means 29, 30 to the first web 35, wherein the roller 14 is moved axially to the right via the axis 30. The sheet 7 is then transported onwards in the transport direction B at high-speed over the rollers 12 and 13 on the second web, until the minimal separation S with respect to the preceding sheet 5 disposed on the first web 35 is reached. Only then is the transport speed of the sheet 7 reduced to that of the sheet 5. Likewise, the fifth sheet 8 is distributed by the distribution means 29, 30 on the second web 36 and subsequently arranged behind the sheet 6 with a minimal separation S to be maintained between the sheets.

When the storage capacity of the stocker 1 is exhausted, meaning that new photographic paper sheets can no longer be accepted, the control means 23 produce an adaptation signal which is transmitted to the exposure station 32 via a connection 34 which connects the control means 23 with the exposure station 32. The exposure station 32 receives information that additional exposed sheets can no longer be inserted into the stocker at the high transport speed of the exposure station 32. The processing speed of the exposure station 32 is then reduced and closely matched to the processing speed of the developing station 33. In this way, a newly exposed photographic paper sheets is inserted into the stocker 1 only when the sheet to be inserted can occupy a storage location in the stocker 1. The insertion speed of a new sheet at the entrance 2 then matches the exit speed of a sheet exiting at the exit 3.

Figure 2:
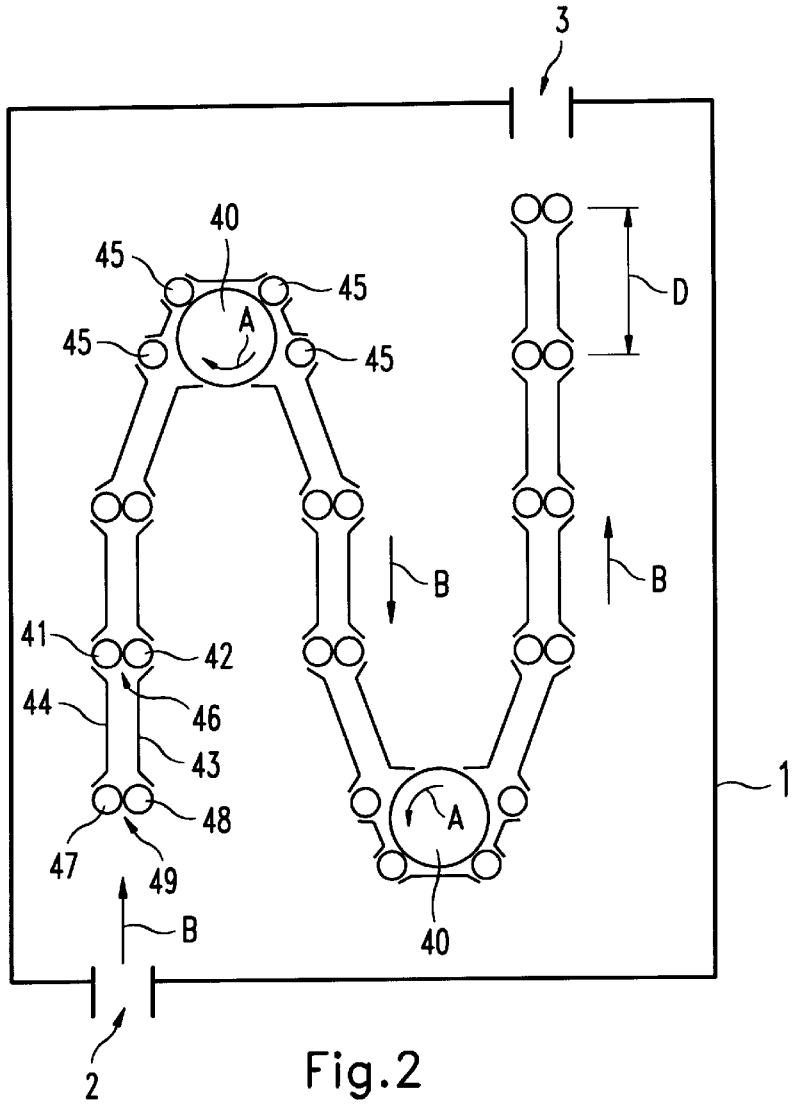
FIG. 2 is a schematic representation of a second embodiment of the device according to the invention.

FIG. 2 shows schematically a second embodiment of a stocker 1 according to the invention. FIG. 2 shows a plurality of roller pairs, wherein two rollers arranged in parallel with each other transport the intermediately stored photographic paper sheets onward. A representative first roller pair 46 is illustrated in FIG. 2 in greater detail. The first roller pair 46 includes a drive roller 41 which can be driven by a drive means (not shown)—for example a stepping motor. An idler roller 42 is arranged in parallel with the drive roller 41. The idler roller 42 does not have its own drive. The idler roller 42 is rotatably supported and can rotate when a photographic paper sheets passes between the drive roller 41 and the idler roller 42. In other words, the rotation of the drive roller 41 is transferred to the idler roller 42 by the photographic paper sheets. Alternatively, the idler roller may have its own drive which will then have to be matched to the rotation speed of the drive roller 41. Also shown in detail in FIG. 2 is a second roller pair 49 consisting of a drive roller 47 and an idler roller 48 arranged in parallel.

To improve the guidance of the photographic paper sheets transported through the stocker 1, guide plates are provided between the individual roller pairs. A first such guide plate 43 which extends from the idler roller 42 of the first roller pair 46 to the idler roller 48 of the second roller pair 49, is illustrated in FIG. 2. A second guide plate 44 extends parallel to the first guide plate 43 at the opposite side of the transport path of the intermediately stored sheets. In other words, the second guide plate 44 extends from the drive roller 41 to the drive roller 47. According to the second embodiment, the transport path of the photographic paper sheets through the stocker 1 is arranged in a serpentine fashion. In this way, the stocker 1 can have a small footprint and, at the same time, a large storage capacity. A serpentine transport path of this type can be realized by providing the stocker 18 with large deflection rollers 40 which are located at the reversing points of the transport path where the transport direction B of the sheets is reversed. Several small deflection rollers 45 are arranged along the outer circumference of the deflection rollers 40. The large deflection rollers 40 can be driven by dedicated drive means (not shown), whereas the small deflection rollers 45 are idler rollers which are not driven. To improve guiding of the photographic paper sheets to be transported, guide plates are also arranged between the individual small deflection rollers 45 along the transport path of the photographic paper sheets. The guide plates arranged between the small deflection rollers 45 in the reversing region may be replaced by a transport band which is stretched around the small deflection rollers 45 to guide the photographic paper sheets. The rotation motion of the large deflection rollers 40 is transferred to the band and to the small deflection rollers 45 by the sheet to be reversed.

Figure 3:
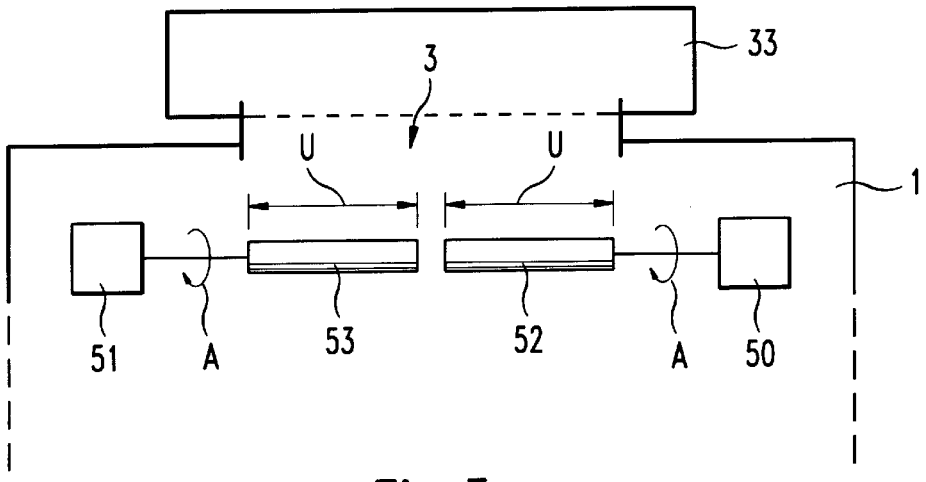
FIG. 3 is a schematic representation of a third embodiment with two sub-rollers arranged side-by-side.

In the third embodiment illustrated in FIG. 3, there is shown a schematic partial view of the stocker 1 according to the invention with two sub-rollers 52 and 53 arranged side-by-side before the exit 3 of the developing station 33. The sub-rollers 52 and 53 operate as parallel web roller for the parallel transport of two webs of photographic paper sheets positioned side-by-side. The first sub-roller 52 is connected to a stepping motor 50, and the second sub-roller is connected to a stepping motor 51. The two stepping motors 50 and 51 can control and drive the two sub-rollers 52 and 53 independently of each other in the rotation direction A. Each of the two sub-rollers 52 and 53 has a respective width U to transport a single sheet of photographic material. Both sub-rollers 52 and 53 can be arranged coaxially and rotatably on a common thin cylindrical roller (not shown). The two sub-rollers 52 and 53 can also be used for the intermediate storage of sheets. Since the two sub-rollers 52 and 53 can be driven independently of each other, the sheets intermediately stored with the sub-rollers can also be transferred consecutively and separately from each other through the exit 3 to the developing station 33. Unlike the first embodiment of FIG. 1, in this embodiment the sheets do not have to be offset relative to each other. This arrangement increases the storage capacity of the stocker 1 over that of the embodiment of FIG. 1 even further, without requiring additional space.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A device (1) for an intermediate storage of photographic material in sheet form (4–8) comprising an entrance (2) for receiving the material (4–8);

an exit (3) for discharging the material (4–8);

a plurality of rotatably supported rollers (9–16; 40, 41) for transporting the material in sheet form (4–8) from the entrance (2) to the exit (3);

at least one drive means (17–22) for driving the plurality of rollers (9–16; 40, 41);

a monitoring means (23, 24A, 24B) for monitoring positions of intermediately stored sheets (4–8) of the photographic material (4–8); and a control means (23) for controlling the rotation speeds of the driveable plurality of rollers, so that during operation the rotation speed of at least one roller of the plurality of rollers can be adjusted independently of the rotation speeds of the remaining plurality of rollers and dependent on the monitored positions.

2. The device according to claim 1, wherein the material in sheet form (4–8) has a sheet length (P), and wherein a separation (D) between any two driveable rollers is smaller than or equal to the sheet length (P) of the material in sheet form (4–8), and the material in sheet form (4–8) is transported along a longitudinal direction (B) of the sheet.

3. The device according to claim 2, wherein the additional rotatably supported rollers (42) are arranged in parallel with the second driveable rollers (41), so that each of two parallel rollers (41,42) form a roller pair and the material in sheet form (4–8) can be guided between the two parallel rollers (41,42) of the respective roller pair.

4. The device according to claim 3, wherein the entrance (2) is designed so as to be connectable to a station (32) for exposing the material (4–8) and the exit (3) is designed so as to be connectable to a station (33) for developing the material (4–8).

5. The device according to claim 4, wherein the control means (23) for controlling the rotation speed of the first and second rollers (9–16; 40,41) adjusts the rotation speeds in such a way that a predetermined minimal separation (S) is maintained between two consecutive sheets of the photographic material (4–8) which is intermediately stored before the exit (3).

6. The device according to claim 5, wherein each of the driveable rollers can be driven by its own dedicated drive means.

7. The device according to claim 5, wherein the device comprises a common drive means (20, 22) for driving several of the driveable rollers (12, 13,15, 16) and a connecting means (25–28) for connecting the common drive means (20, 22) with at least one of the rollers (12, 13,15, 16) that can be driven by the common drive means (20, 22).

8. The device according to claim 7, wherein the monitoring means (23, 24A, 24 B) comprise at least one sensor (24A, 24 B) adapted to detect one of the sheets of the photographic material (4–8) which is to be intermediately stored, when the sheet enters the entrance (2) of the device (1).

9. The device according to claim 8, wherein the at least one drive means (17–22) is a stepping motor.

10. The device according to claim 9, wherein the monitoring means (23, 24A, 24 B) is adapted to monitor the steps executed by the at least one stepping motor (17–22) for driving the rollers (9–16; 40, 41) and to determine positions of intermediately stored sheets (4–8) in response to the monitored steps.

11. The device according to claim 10, wherein the device includes a sensor (31) for recognizing slippage which can occur between the first and the second rollers (9–16; 40, 41) and the sheets (4–8) to be transported.

12. The device according to claim 4, wherein the control means (23) is capable of producing an adaptation signal for adapting the speed at which the sheets are received at the entrance (2), to the speed at which the sheets are discharged at the exit (3), and wherein the adaptation signal can be transmitted to the exposure station (32) when the storage capacity of the device (1) is completely filled with intermediately stored sheets (4–8) of the photographic material (4–8).

13. The device according to claim 12, wherein several of the first and second rollers are in the form of parallel web rollers (9–13), so that at least two webs (35,36) of sheets (4–8) of photographic material arranged side-by-side can be transported, and wherein the device (1) includes a distribution means (29,30) for distributing the sheets to one of the at least two webs (35,36).

14. The device according to claim 13, wherein the parallel web rollers (9–13) have a width (L) adapted to transport at least two sheets (4–8) of the photographic material side-by-side.

15. The device according to claim 13, wherein each of the parallel web rollers (9–13) has at least two individually driveable sub-rollers which are arranged side-by-side and have a width adapted to transport a single sheet (4–8) of photographic material.

16. The device according to claim 15, wherein the intermediate storage is for photographic paper (4–8) in sheet form.

17. The device according to claim 15, wherein during operation, the rotation speeds of each of the first driveable rollers can be adjusted independent of the rotation speeds of the second driveable rollers (9–16; 40, 41).

* * * * *